US005419935A

United States Patent [19]

Butera

[11] Patent Number: 5,419,935

[45] Date of Patent: May 30, 1995

[54] PACKAGING FOR CEDAR PRODUCTS

[76] Inventor: Joseph F. Butera, 420 Howard Rd., Gladwyne, Pa. 19035

[21] Appl. No.: 999,282

[22] Filed: Dec. 29, 1992

[51] Int. Cl.[6] ..... B27N 5/02; B32B 23/08

[52] U.S. Cl. ..... 428/35.6; 428/511; 428/910; 428/913

[58] Field of Search ..... 428/511, 35.6, 913, 428/910

[56] References Cited

U.S. PATENT DOCUMENTS 1,488,044 3/1924 Harms .
1,488,634 4/1924 Dunham .
1,799,788 4/1931 Fischer .
2,062,179 11/1936 Hunter .
2,189,955 2/1940 Hokerk .
3,099,568 7/1963 Brody et al. .
3,460,961 8/1969 Young, Jr. et al. ..... 428/483

*Primary Examiner*—P. C. Sluby
*Attorney, Agent, or Firm*—Steve Mendelsohn; Robert E. Rosenthal; William H. Murray

[57] ABSTRACT

A container for cedar products having a transparent wall portion and an opaque wall portion. The transparent wall portion has high transmissivity in the visible light range and low transmissivity in the ultraviolet light range. The opaque wall portion contains a coating that prevents chemicals given off by cedar wood from diffusing into the opaque wall portion.

5 Claims, 1 Drawing Sheet

PACKAGING FOR CEDAR PRODUCTS

BACKGROUND OF THE INVENTION

Field of the Invention

The present invention relates to packaging, and, in particular, to packaging for products containing cedar wood.

Statement of Related Art

A cedar product is any product that is made entirely or partially of cedar wood. Cedar products are conventionally sold in transparent plastic bags or in paperboard folding cartons that may have a transparent window. It is desirable to provide packaging for cedar products that identifies and favorably presents the product to the consumer when the item is on display in a store. It is also desirable to provide packaging for cedar products that is compact and efficient for stacking and displaying items on store shelves. It is further desirable to provide packaging for cedar products that ensures long shelf life.

It is known that products made of cedar wood degrade over time. This degradation includes discoloration of the surface of the cedar wood. This results in an unattractive brownish hue, whereas a reddish color is both more attractive and is more readily recognized as cedar. It has been generally assumed in the art that this discoloration is caused by interaction of cedar wood with air. Furthermore, it is known that cedar products outgas terpene solvents that adversely interact with oil-based ink conventionally used on paperboard folding cartons. The printing on such packaging becomes blurred over time as a result of this interaction. Consequently, the shelf life of the cedar products is limited.

It is an object of this invention to provide packaging for cedar products that permits a consumer to view the enclosed cedar product, prevents color degradation of the cedar product, and prevents adverse interaction of the cedar product with ink used on the packaging material.

Additional objects and advantages of the invention will become evident from the detailed description of a preferred embodiment which follows.

SUMMARY OF THE INVENTION

The invention is packaging for cedar products having a transparent wall portion of high transmissivity in the visible light range and low transmissivity in the ultraviolet light range.

The invention is also packaging for cedar products having an opaque wall portion, where the opaque wall portion has a protective coating that tends to prevent diffusion of chemicals from the cedar product into the opaque wall portion.

The invention is also a method for packaging a cedar product, comprising the step of placing the cedar product inside a container having an opaque wall portion. The opaque wall portion has on an interior surface thereof a coating that tends to prevent diffusion of chemicals from the cedar product into the opaque portion.

DETAILED DESCRIPTION OF A PREFERRED EMBODIMENT OF THE INVENTION

Figure 1:
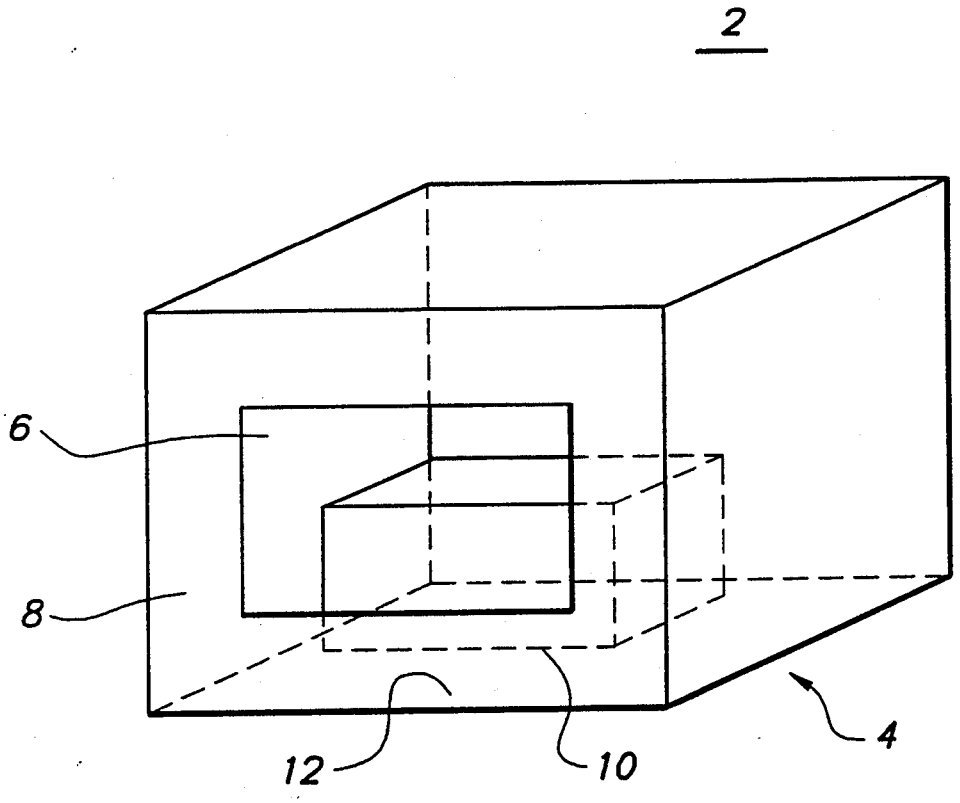
FIG. 1 is a perspective view of packaging for cedar products according to a preferred embodiment of the present invention.

FIG. 1 shows a perspective view of packaging 2 for cedar product 10 according to a preferred embodiment of the present invention. Packaging 2 is preferably a folding carton that comprises rectangular container 4 having window 6 defined in wall 8 of container 4.

Window 6 of packaging 2 is made of a material that has high transmissivity to visible light and low transmissivity to ultraviolet light. For example, window 6 may be a flexible plastic material having these characteristics. In one preferred embodiment, window 6 is comprised of "MYLAR" (a registered trademark of E. I. Du Pont de Nemours and Company) brand film, manufactured by E. I. Du Pont de Nemours and Company, Wilmington, Del. Window 6 permits consumers to view cedar product 10 enclosed in packaging 2, while preventing the exposure of the cedar product to ultraviolet light. By preventing exposure of the cedar product to ultraviolet light, discoloration of the surface of the cedar product is reduced. The inventor has discovered that, contrary to the conventional understanding in the art, discoloration of the surface of cedar wood is caused by exposure to ultraviolet light and not by exposure to air.

Figure 2:
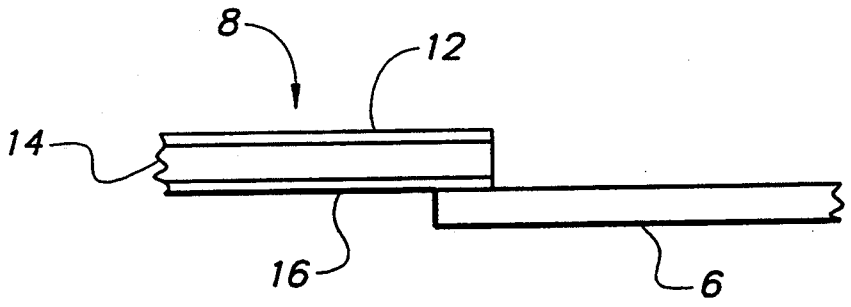
FIG. 2 is a partial cross-section of the packaging for cedar products of FIG. 1.

FIG. 2 shows a partial cross-section of packaging 2 for cedar product 10 containing part of wall 8 and of window 6. Wall 8 of container 4 may be made on an opaque wood product 14 such as paperboard that is coated on the inside surface - that is, the surface facing the interior of container 4 - with ultraviolet coating 12. Ultraviolet coating 12 forms a protective barrier that tends to prevent chemically, such as terpene solvents, given off by cedar wood from diffusing into paperboard wall 8 and adversely interacting with the oil-based ink used in printing on the paperboard. Ultraviolet coatings are known in the packaging art. These coatings are typically applied to the outside surface of paperboard folding cartons to provide a high gloss finish. Wall 8 may also be coated with ultraviolet coating 16 on the outside surface of container 4. Window 6 of container 4 is preferably glued to wall 8 to form an airtight seal with wall 8.

In a preferred embodiment, wall 8 of container 4 is comprised of paperboard that is hard finished on the inside surface as well as the outside surface. In conventional folding cartons, the outside surface is hard finished to provide a surface upon which oil-based ink and ultraviolet coating 16 may be applied. In the present invention, the inside surface of wall 8 is also hard finished to provide a surface upon which ultraviolet coating 12 may be applied.

In one preferred embodiment, wall 8 is composed of solid bleached sulfite paperboard. Window 6 is preferably attached to wall 8 using an adhesive that is substantially impervious to interaction with chemicals, such as terpene solvents, given off by cedar wood. This preferred embodiment results in a longer shelf-life for cedar products packaged according to the present invention.

It will be understood that the container of the present invention may assume any shape useful in packaging cedar products, and that the box shape shown in FIG. 1 is merely illustrative of the present invention. Furthermore, those skilled in the art will understand that the container of the present invention may be made of materials other than paperboard. The problem of chemicals given off by cedar wood diffusing into container walls is not confined to paperboard. Ultraviolet coating may be used as a coating on a wide variety of container materials.

It will also be understood that within the scope of the present invention is packaging for cedar products in which the window constitutes the entire package - that is, where the entire package is made of the window material. In this embodiment of the present invention, the cedar product may be contained in a bag consisting substantially or entirely of a suitable plastic film, such as "MYLAR" brand film.

It will be further understood that various changes in the details, materials, and arrangements of the parts that have been described and illustrated in order to explain the nature of this invention may be made by those skilled in the art without departing from the principle and scope of the invention as expressed in the following claims.

What is claimed is:

1. Packaging for a cedar product comprising an opaque wall portion, wherein the interior surface of said opaque wall portion has a protective barrier that inhibits diffusion of chemicals from said cedar product into said opaque wall portion.

2. The packaging of claim 1 wherein said opaque wall portion comprises paperboard.

3. The packaging of claim 1, wherein said protective barrier is an ultraviolet coating.

4. The packaging of claim 1, further comprising a transparent wall portion, adjacent to said opaque wall portion, of transmissivity in the visible light range greater than transmissivity in the ultraviolet light range.

5. The packaging of claim 4, wherein said transparent wall portion being a plastic film.

* * * * *